US011971027B2

(12) United States Patent
Chou et al.

(10) Patent No.: US 11,971,027 B2
(45) Date of Patent: Apr. 30, 2024

(54) AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 0 days.

(21) Appl. No.: 17/746,734

(22) Filed: May 17, 2022

(65) Prior Publication Data

US 2022/0372964 A1 Nov. 24, 2022

(30) Foreign Application Priority Data

May 24, 2021 (TW) ..... 110118732

(51) Int. Cl.

| | |
|---|---|
| ***F04B 39/14*** | (2006.01) |
| ***F04B 35/04*** | (2006.01) |
| ***F04B 39/06*** | (2006.01) |
| ***F04B 39/12*** | (2006.01) |
| ***F04B 53/22*** | (2006.01) |

(52) U.S. Cl.

CPC ..... *F04B 39/14* (2013.01); *F04B 35/04* (2013.01); *F04B 39/066* (2013.01); *F04B 39/121* (2013.01); *F04B 53/22* (2013.01)

(58) Field of Classification Search

CPC ..... F04B 35/04; F04B 39/14; F04B 39/066; F04B 39/121; F04B 53/22

USPC ..... 29/426.6, 426.5, 513

See application file for complete search history.

(56) References Cited

U.S. PATENT DOCUMENTS

| | | | | |
|---|---|---|---|---|
| 5,040,269 | A * | 8/1991 | Lyons, Jr. | F16B 17/004 403/402 |
| 6,629,827 | B2 * | 10/2003 | Chou | F04B 35/04 417/415 |
| 7,318,422 | B2 * | 1/2008 | Douyama | F04B 17/03 123/495 |
| 7,819,636 | B2 * | 10/2010 | Huang | F04B 45/043 417/523 |

(Continued)

FOREIGN PATENT DOCUMENTS

| | | |
|---|---|---|
| CN | 206283384 | 6/2017 |
| EP | 3670911 | 6/2020 |

(Continued)

OTHER PUBLICATIONS

"Search Report of Europe Counterpart Application", dated Sep. 12, 2022, p. 1-p. 9.

(Continued)

*Primary Examiner* — Christopher S Bobish
(74) *Attorney, Agent, or Firm* — JCIPRNET

(57) ABSTRACT

An air compressor is received in an accommodation box and contains a body, a cylinder, a motor, and a transmission mechanism. The body includes a first positioning orifice and a second positioning orifice. The cylinder is connected on the body and communicates with an air storage holder. The motor is fixed on the body, a small gear is received in the first positioning orifice, and a connection seat is accommodated in the first orifice. The transmission mechanism actuates a piston to move in the cylinder reciprocately so as to produce compressed airs. The motor includes at least one locking extension for engaging the motor with the body, hence the motor is fixed on the body securely without using any screws.

5 Claims, 13 Drawing Sheets

(56) References Cited

U.S. PATENT DOCUMENTS

| | | | | |
|---|---|---|---|---|
| 8,629,583 | B2 * | 1/2014 | Bernhardt | H02K 7/14 310/91 |
| 10,047,737 | B2 * | 8/2018 | Meza | F04B 53/16 |
| 10,549,631 | B2 * | 2/2020 | Hanby | F02M 37/0052 |
| 10,641,261 | B2 * | 5/2020 | Inoue | F04B 1/145 |
| 11,098,684 | B2 * | 8/2021 | Takemura | F02M 37/106 |
| 11,242,855 | B2 * | 2/2022 | Imai | F04D 13/06 |
| 2003/0107284 | A1 * | 6/2003 | Wickham | H02K 5/00 310/90 |
| 2008/0199324 | A1 * | 8/2008 | Yang | F04B 33/005 417/234 |
| 2014/0127060 | A1 * | 5/2014 | Richter | F04D 29/406 417/423.7 |
| 2015/0110652 | A1 * | 4/2015 | Hoshi | F04D 13/02 417/420 |
| 2015/0330379 | A1 * | 11/2015 | Chou | F04B 39/0094 417/374 |
| 2015/0337825 | A1 * | 11/2015 | Chou | F04B 37/18 417/415 |
| 2017/0033642 | A1 * | 2/2017 | Chou | H02K 9/06 |
| 2018/0017056 | A1 * | 1/2018 | Ohno | F04C 29/12 |
| 2018/0223824 | A1 * | 8/2018 | Inoue | F04B 39/14 |
| 2020/0208620 | A1 | 7/2020 | Chou et al. | |
| 2022/0178366 | A1 * | 6/2022 | Beaudry | F04B 53/22 |

FOREIGN PATENT DOCUMENTS

| | | |
|---|---|---|
| JP | 2015224630 | 12/2015 |
| JP | 2016169736 | 9/2016 |
| JP | 2018110468 | 7/2018 |
| JP | 2018123809 | 8/2018 |
| JP | 2020094585 | 6/2020 |
| JP | 2020097936 | 6/2020 |
| JP | 3238384 | 7/2022 |
| KR | 200384518 | 5/2005 |
| KR | 20180061540 | 6/2018 |
| KR | 1020200075748 | 6/2020 |

OTHER PUBLICATIONS

"Office Action of Japan Counterpart Application", dated Jun. 6, 2023, p. 1-p. 6.

"Office Action of Korea Counterpart Application No. 10-2022-0058016", dated Dec. 20, 2023, with English translation thereof, p. 1-p. 19.

* cited by examiner

AIR COMPRESSOR

FIELD OF THE INVENTION

The present invention relates to an air compressor which is capable of connecting the motor on the body securely without using any screws.

BACKGROUND OF THE INVENTION

A conventional air compressor contains a body, a cylinder connected on the body, a motor fixed on the body, and a piston driven by the motor to move in the cylinder reciprocately, such that the motor actuates the piston to move in the cylinder reciprocately, thus sucking, compressing, and discharging airs. Furthermore, the air compressor is received in an accommodation box.

The motor is fixed on the body by screws, but it is easy to remove from the body after a period of using time. When the screws are inserted through the body to screw with multiple threaded orifices of a casing of the motor, a tool is difficult to screw the screws with the multiple threaded orifices in a limited space. Therefore, the motor cannot be fixed on the body by using the screws easily.

The present invention has arisen to mitigate and/or obviate the afore-described disadvantages.

SUMMARY OF THE INVENTION

The primary aspect of the present invention is to provide an air compressor which is received in an accommodation box, the motor includes multiple coupling orifices defined thereon and configured to engage on the multiple posts of the body, and the motor further includes at least one locking extension configured to engage with the body, thus connecting the motor on the body securely without using any screws.

Further aspect of the present invention is to provide an air compressor by which the motor is removed from the body by using a removal tool, and the removal tool is configured to press the at least one locking extension away from the body, thus removing the motor from the body easily and quickly.

Another aspect of the present invention is to provide an air compressor by which the air compressor is received in the accommodation box, two abutting portions are formed on an inner wall of a first casing and an inner wall of a second casing of the accommodation box, and the two abutting portions are formed on the inner wall of the first casing and the inner wall of the second casing of the accommodation box, such that the two wings of the two locking extensions are positioned between the motor and the body, and the air compressor is received in the accommodation box stably by using the two wings.

DETAILED DESCRIPTION OF THE PREFERRED EMBODIMENTS

Figure 1:
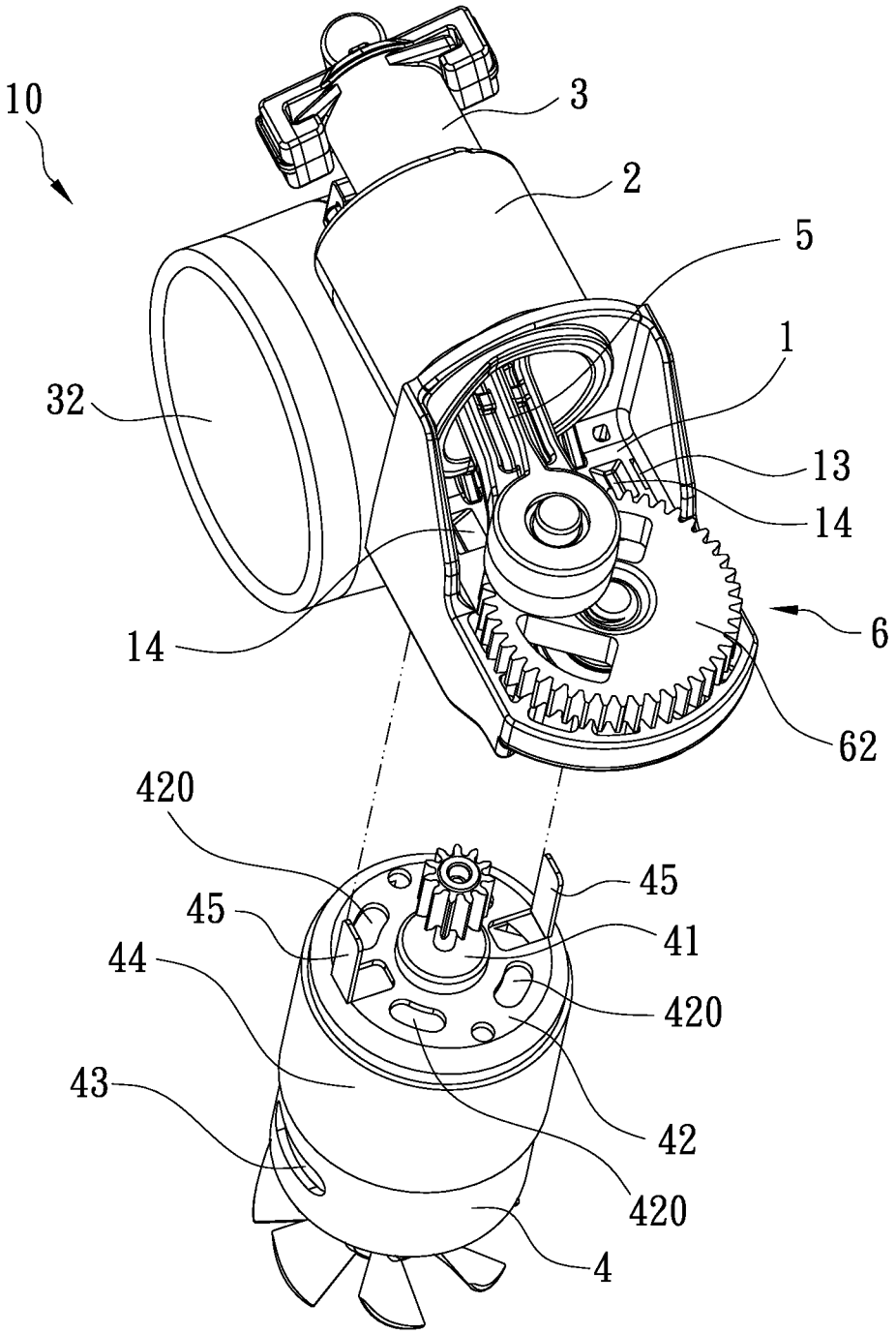
FIG. 1 is a perspective view showing the exploded components of a part of an air compressor according to a first embodiment of the present invention.
Figure 2:
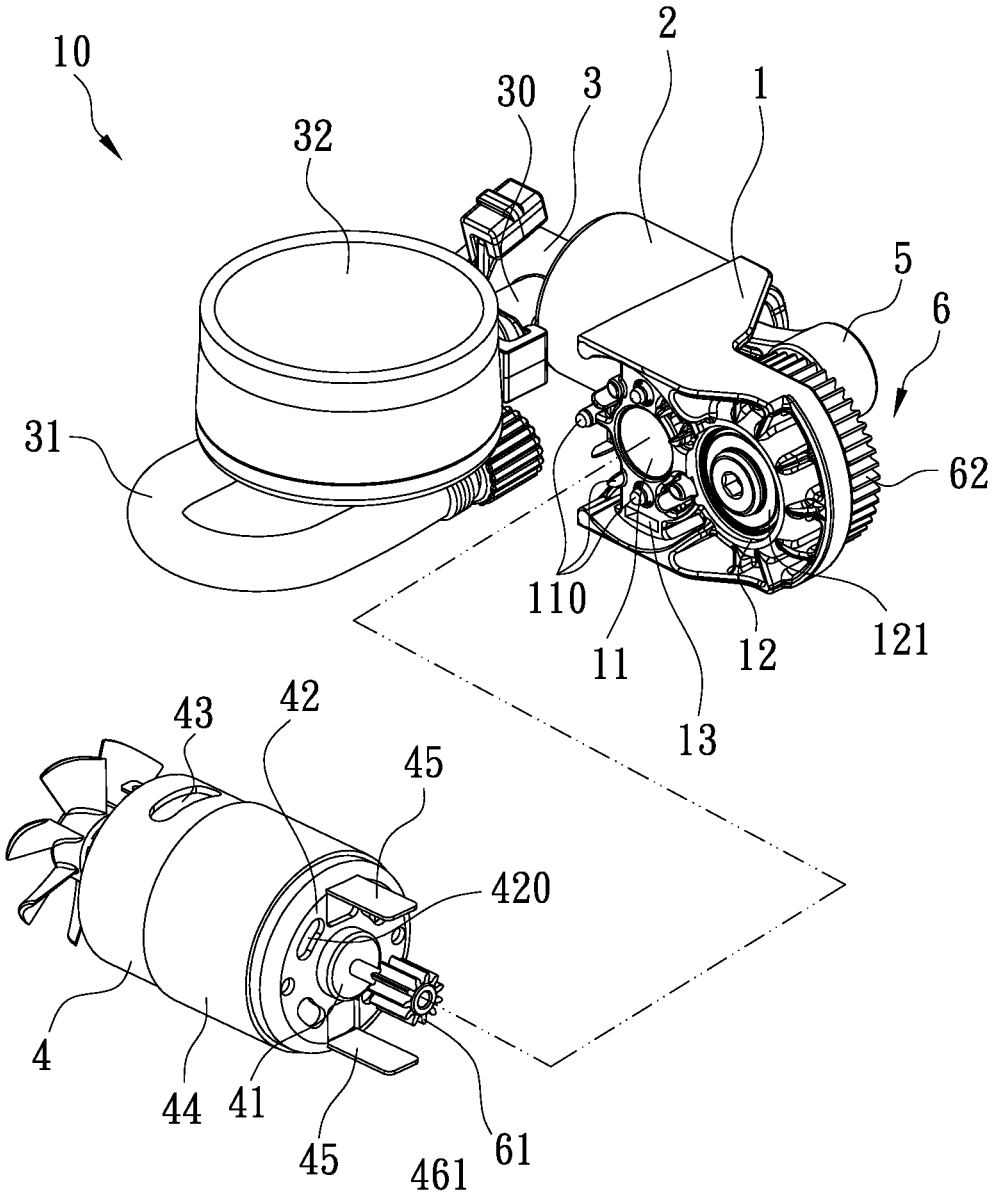
FIG. 2 is another perspective view showing the exploded components of a part of the air compressor according to the first embodiment of the present invention.
Figure 3:
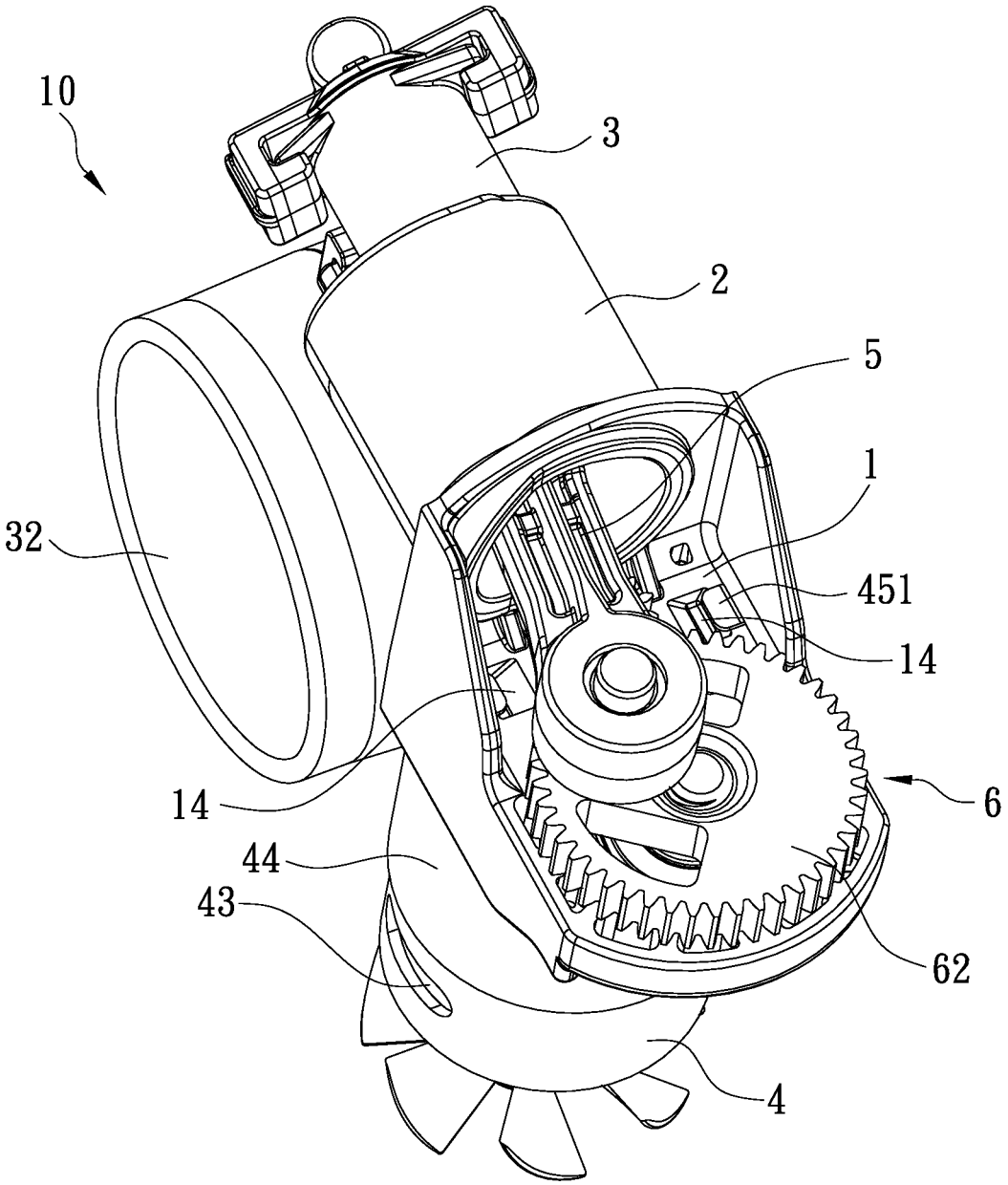
FIG. 3 is a perspective view showing the assembly of the air compressor according to the first embodiment of the present invention.
Figure 4:
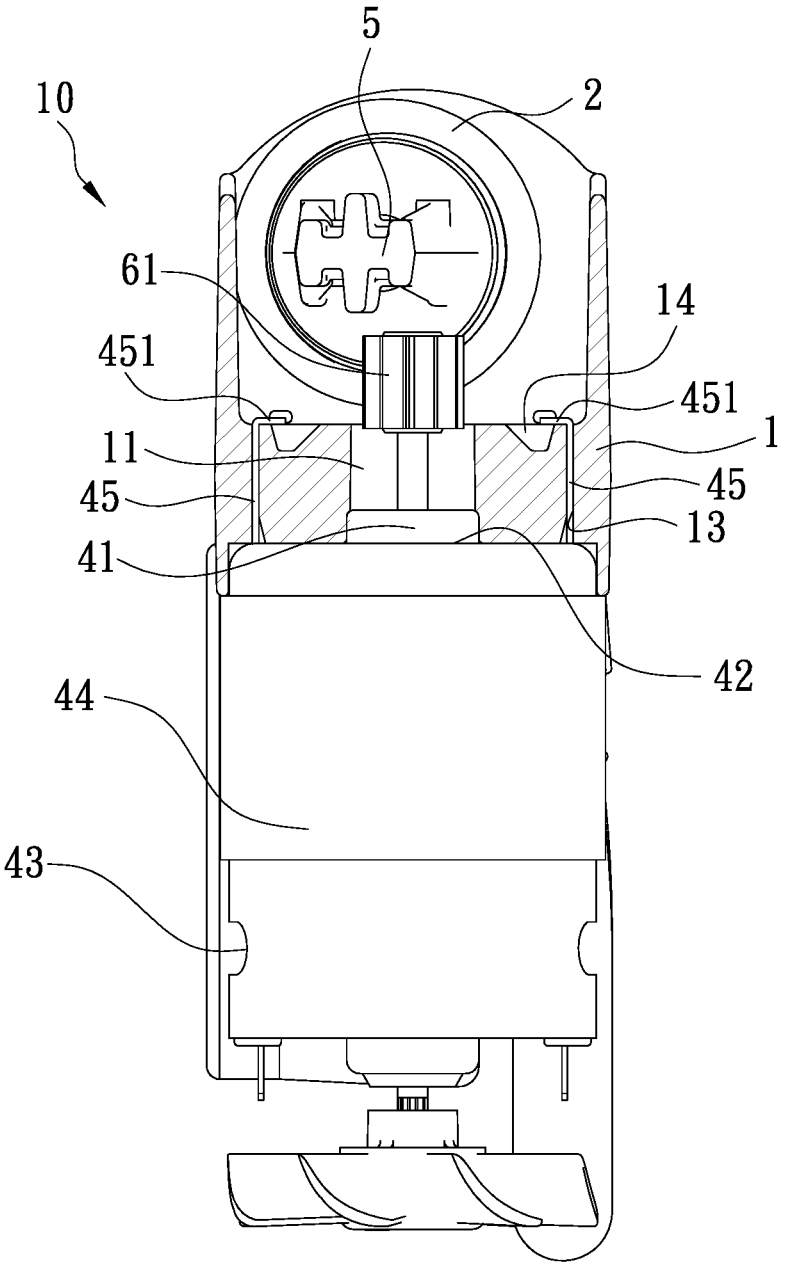
FIG. 4 is a cross sectional view showing the assembly of the air compressor according to the first embodiment of the present invention.
Figure 12:
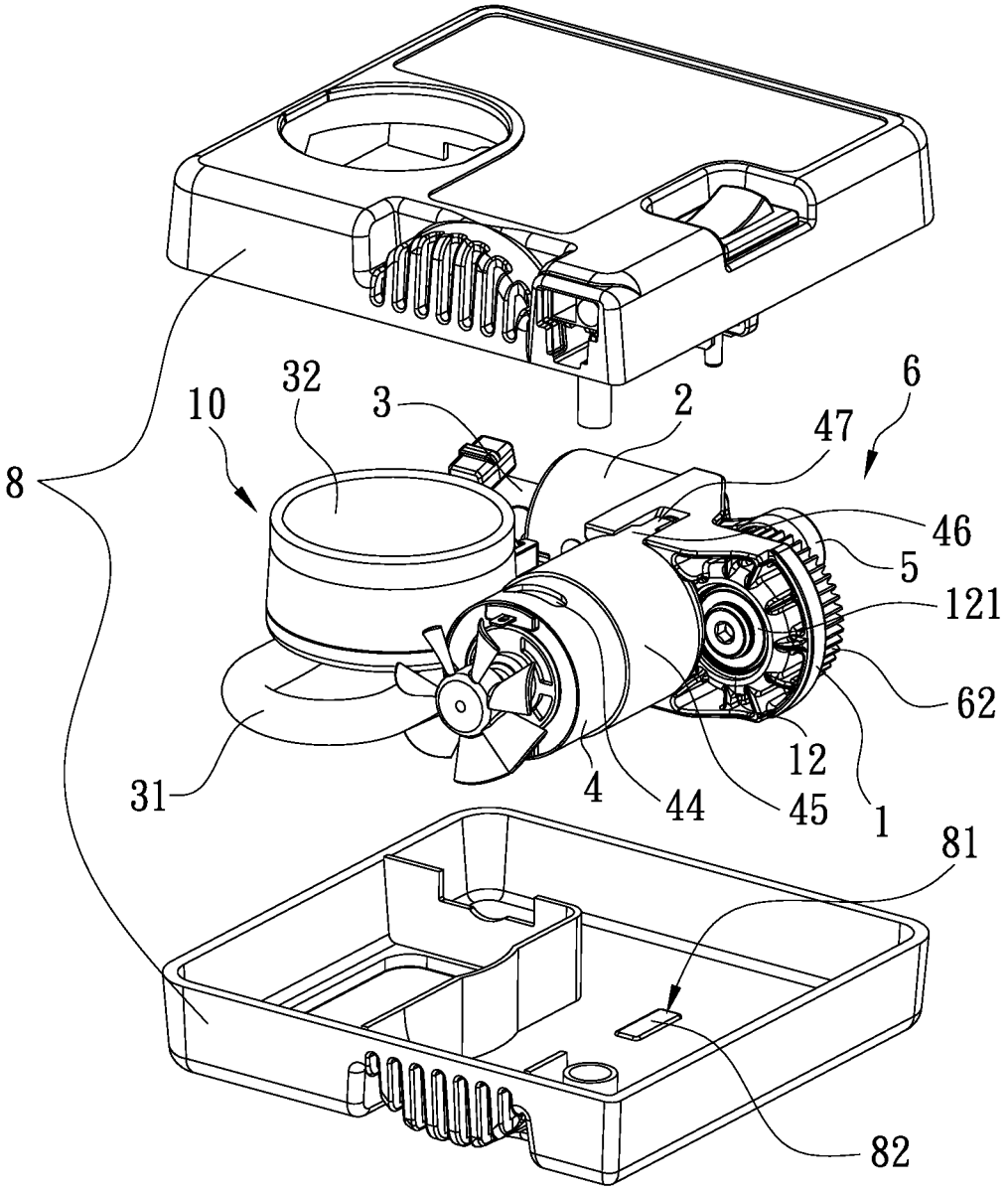
FIG. 12 is a perspective view showing the operation of the air compressor of the present invention.

With reference to FIG. 12, an air compressor 10 according to a first embodiment of the present invention is received in an accommodation box 8. Referring to FIGS. 1-3, the air compressor 10 comprises a body 1, a cylinder 2 connected on the body 1, a motor 4 fixed on the body 1, and a piston 5 driven by the motor 4 to move in the cylinder 2 reciprocately.

The body 1 includes multiple positioning orifices which are a first positioning orifice 11 and a second positioning orifice 12, wherein a small gear 61 is received in the first positioning orifice 11 and is connected on an end of the motor 4, and a connection seat 41 of the motor 4 is accommodated in the first orifice 11. The second positioning orifice 12 is configured to receive a bearing 121. The motor 4 further includes two dissipation holes 43 symmetrically formed on an outer wall of the casing thereof and configured to circulate airs and to dissipate heat from the motor 4. The motor 4 includes a magnetic coil 44 fitted thereon and made of metal material so as to guide magnetism efficiently, when the motor 4 operates.

The cylinder 2 is one-piece connected on the body 1 and is in communication with an air storage holder 3, wherein the air storage holder 3 includes at least one tube 30 in which an air hose 31 and a pressure gauge 32 are received.

A transmission mechanism 6 includes a large gear 62 having a counterweight block and configured to mesh with the small gear 61, wherein the large gear 62 is connected with a bearing 121 by using a shaft (not shown), and the transmission mechanism 6 actuates the piston 5 to move in the cylinder 2 reciprocately so as to produce compressed airs.

Figure 6:
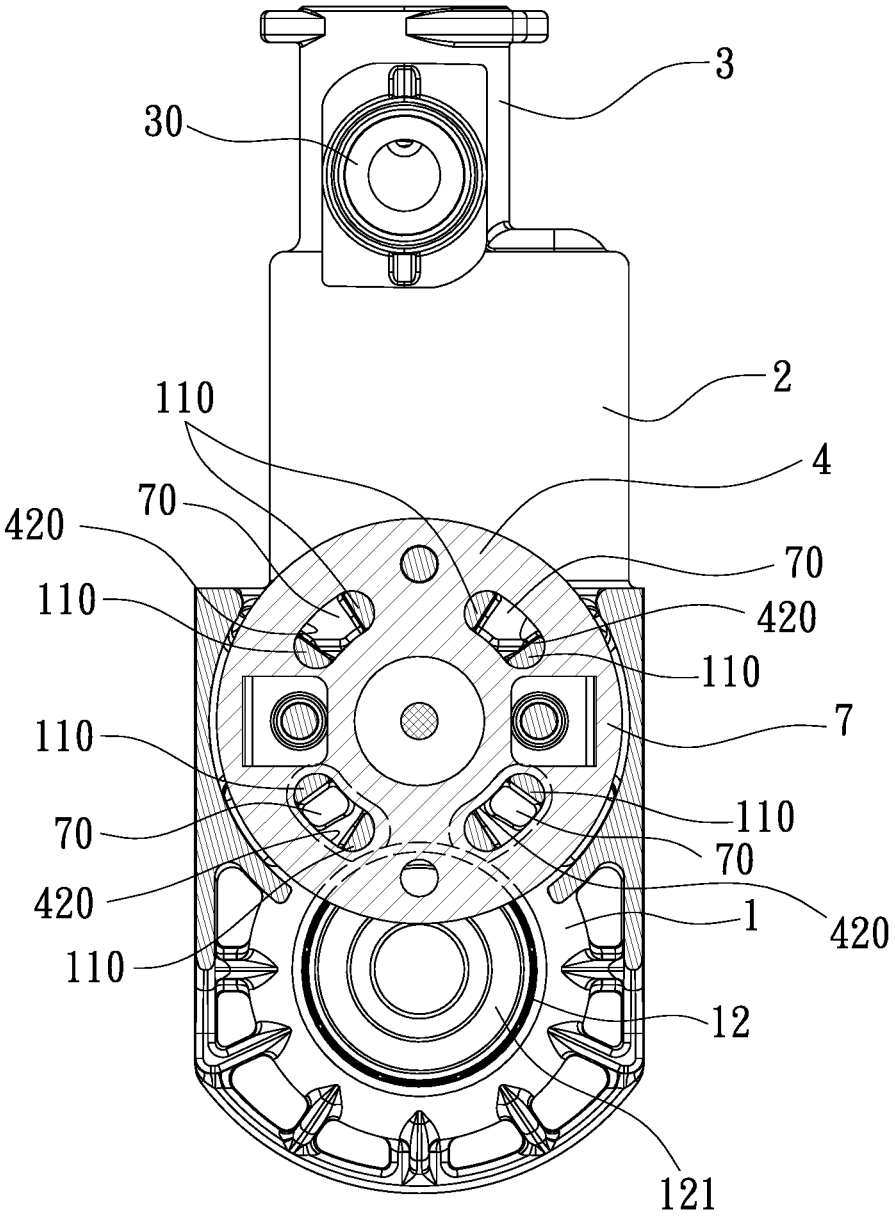
FIG. 6 is a cross sectional view showing the operation of the air compressor according to the first embodiment of the present invention.
Figure 7:
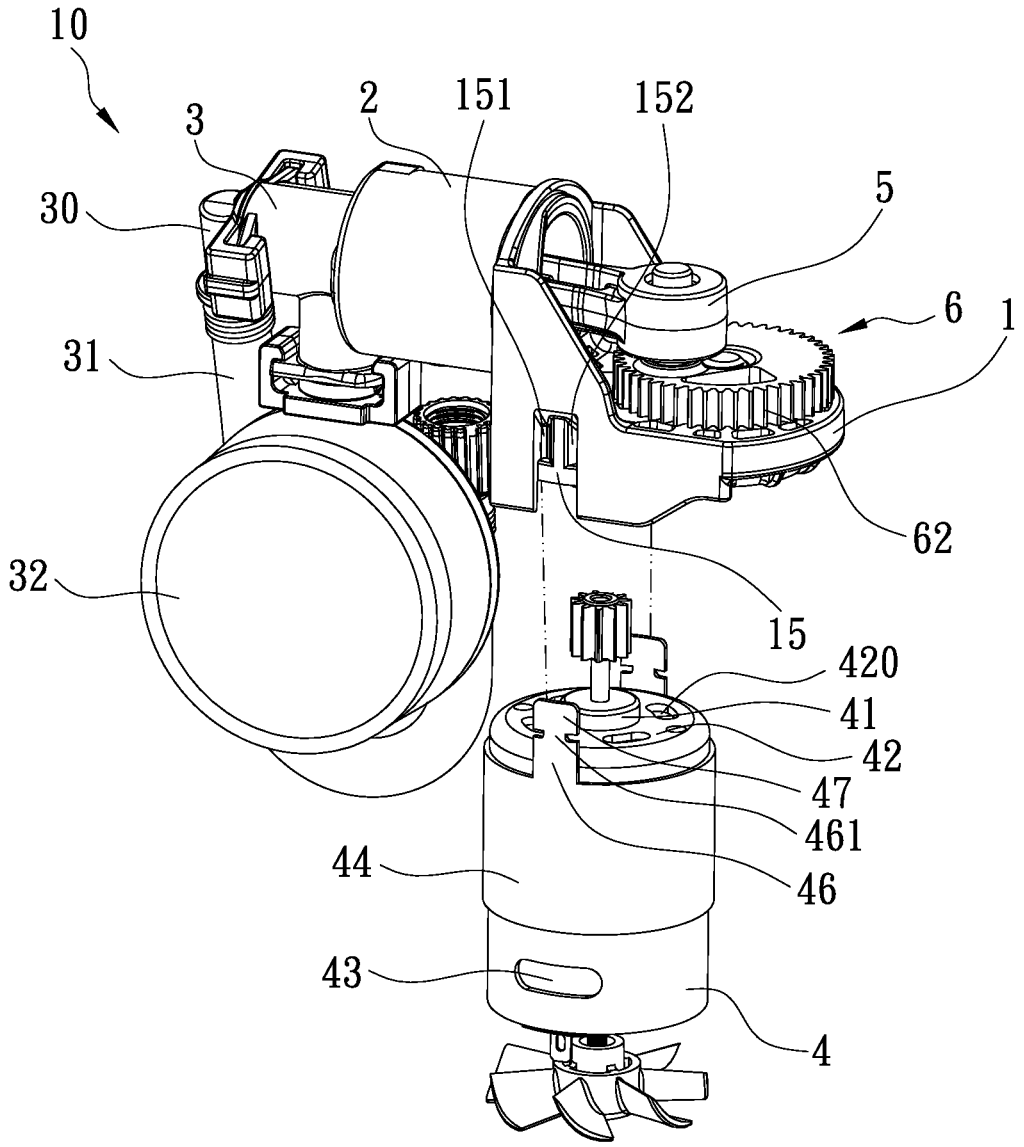
FIG. 7 is a perspective view showing the exploded components of a part of an air compressor according to a second embodiment of the present invention.
Figure 8:
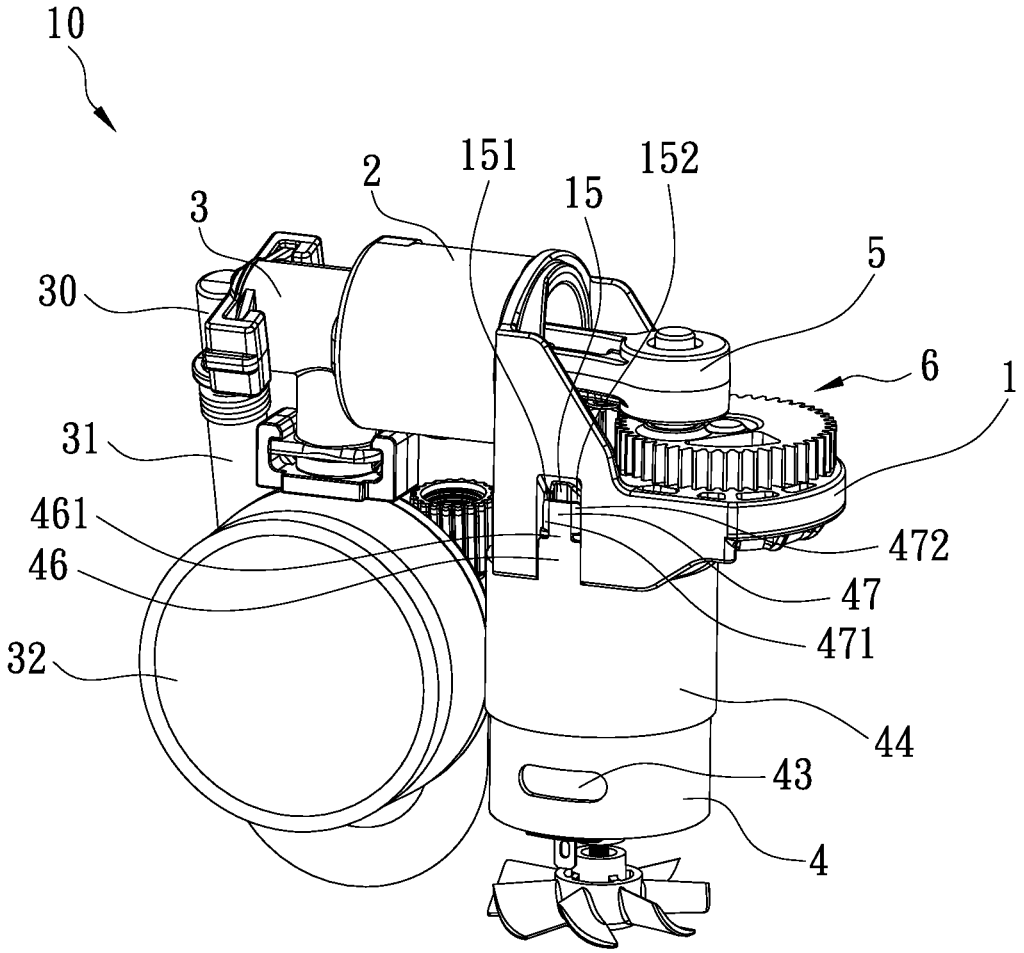
FIG. 8 is a perspective view showing the assembly of a part of the air compressor according to the second embodiment of the present invention.
Figure 9:
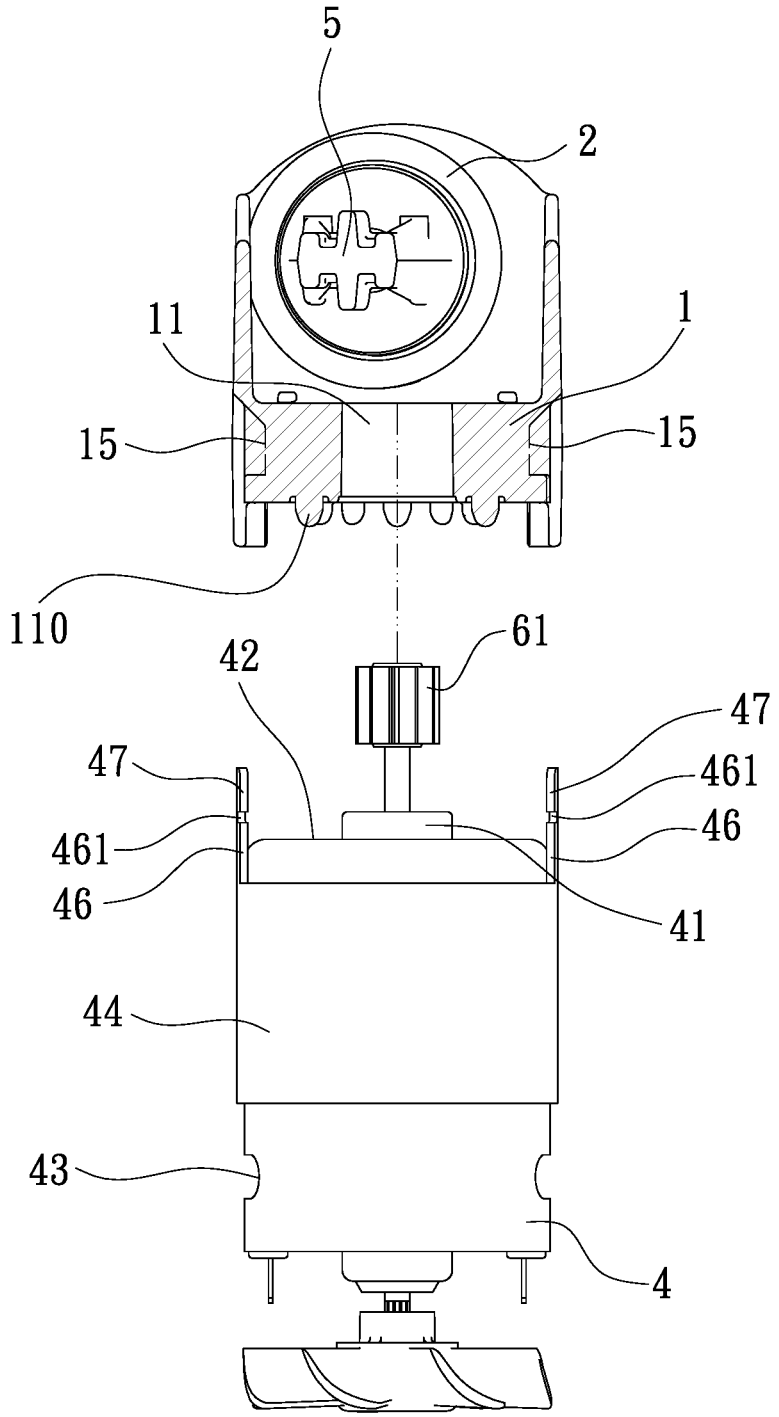
FIG. 9 is a cross sectional view of FIG. 7.
Figure 10:
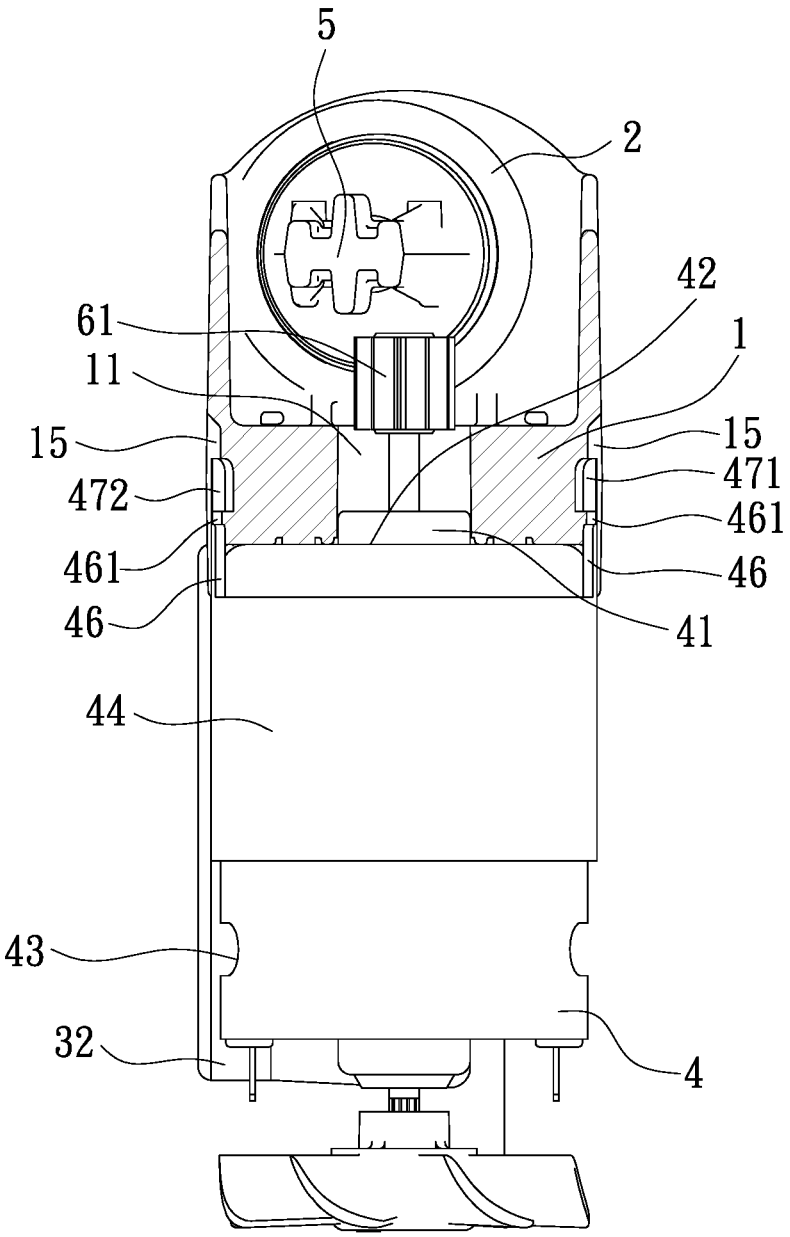
FIG. 10 is a cross sectional view of FIG. 8.

As shown in FIGS. 1-3, the motor 4 includes multiple coupling orifices 420 defined on an head edge 42 thereof adjacent to small gear 61 and surrounding the connection seat 41, and the body 1 includes multiple posts 110 extending from a first outer wall thereof, surrounding the first positioning orifice 11, and corresponding to the multiple coupling orifices 420, such that when fixing the motor 4 to the body 1, the multiple coupling orifices 420 of the head edge 42 of the motor 4 are engaged on the multiple posts 110 of the body 1 so as to enhance rotating force of the motor 4 and to fix the motor 4 on the body 1 securely. Furthermore, a coupling face 7 has multiple through orifices 70 formed thereon, when the multiple posts 110 of the body 1 are engaged with the multiple coupling orifices 420 of the head edge 42 of the motor 4, as shown in FIG. 6, the connection seat 41 of the head edge 42 of the motor 1 is accommodated in the first positioning orifice 11, wherein the body 1 is engaged with the motor 4 by using at least one locking extensions 45, for example, a first end of a respective one locking extension 45 extends from the motor 4, and a second end of the respective one locking extension 45 is engaged on the body 1, hence the motor 4 is fixed on the body 1 securely without using any screws.

With reference to FIGS. 1-4, the two locking extensions 45 symmetrically extend from the head edge 42 of the motor 4, the body 1 further includes two recesses 13 passing therethrough vertically, and the body 1 includes two notches 14 symmetrically defined on two sides thereof and located inside the two recesses 13, wherein the two locking extensions 45 extend through the two recesses 13 of the body 1, and two distal ends of the two locking extensions 45 are forced by a pressing tool (not shown) to form two symmetrical contact wings 451 for contacting with the body 1, thus fixing the motor 4 on the body 1 without using any screws.

Figure 5:
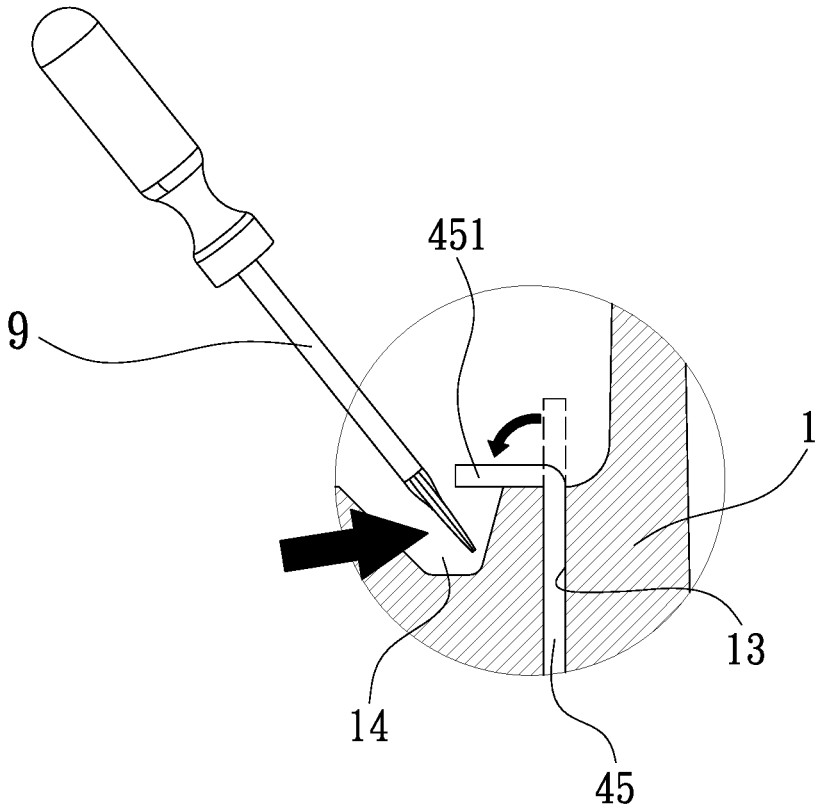
FIG. 5 is an amplified cross-sectional view showing the operation of a part of the air compressor according to the first embodiment of the present invention.

Referring further to FIG. 5, when the motor 4 is removed from the body 1 by ways of a removal tool 9, the removal tool 9 is inserted into a respective one of the two notches 14 of the body 1 and pushes a respective one contact wing 451 of a respective one locking extension 45 away from the body 1, then the motor 4 is moved away from the body 1, wherein the removal tool 9 is a screwdriver.

As illustrated in FIGS. 7 to 10, a difference of a second embodiment from that of the first embodiment comprises: the motor 4 including two locking extensions 46 symmetrically extending from the magnetic coil 44 which is fitted on the motor 4, wherein a respective one locking extension 46 has a neck 461 formed on a distal end thereof, wherein a width of the neck 461 is less than a width of the respective one locking extension 46, and the neck 461 has a wing 47 extending from a distal end thereof, wherein a width of the wing 47 is equal to the width of the respective one locking extension 46, and the body 1 further includes two receiving grooves 15 defined on two sides thereof and corresponding to two wings 47 of the two locking extensions 46, wherein the two receiving grooves 15 are a first receiving groove 151 and a second receiving groove 152, and the two wings 47 are located at the two receiving grooves 15 of the body 1, wherein a pressing tool (not shown) is configured to press the two wings 47 into the first receiving groove 151 and the second receiving groove 152 of the two receiving grooves 15 to form a first bent tab 471 and a second bent tab 472, wherein the first bent tab 471 and the second bent tab 472 are pressed into the two receiving grooves 15, hence the motor 4 is fixed on the body 1 without using any screws.

Figure 11:
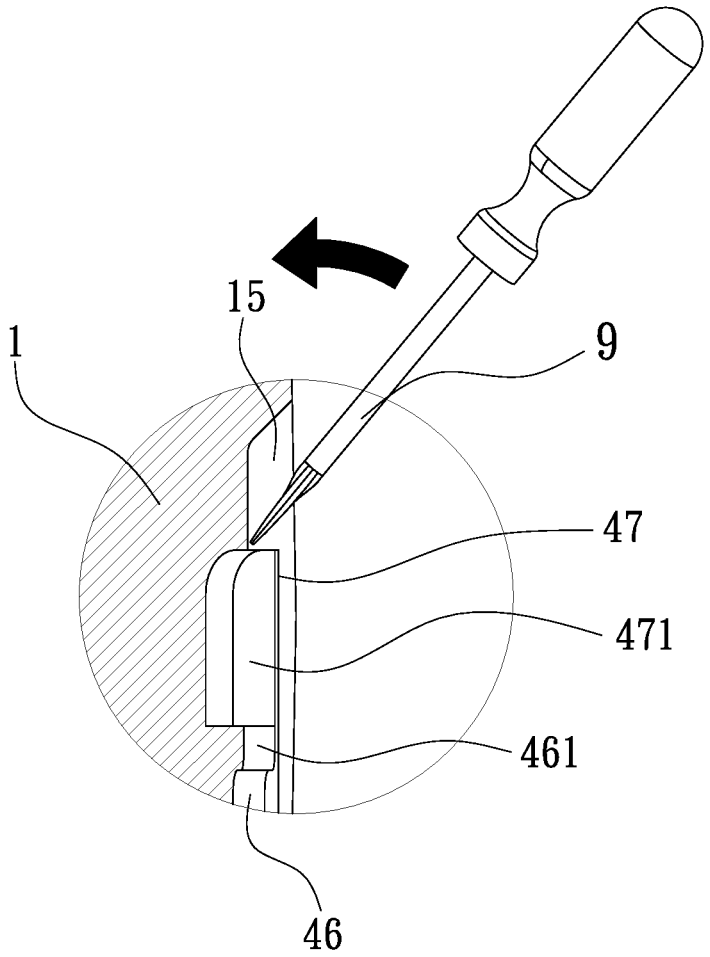
FIG. 11 is an amplified cross-sectional view showing the operation of a part of the air compressor according to the second embodiment of the present invention.

As shown in FIG. 11, the motor 4 is removed from the body 1 by ways of a removal tool 9, wherein the removal tool 9 is inserted into the two receiving groove 15 of the body 1 to move the first bent tab 471 and the second bent tab 471 of the two locking extensions 46 away from of the body 1, and the motor 4 is removed from the body 1 easily and quickly.

Figure 13:
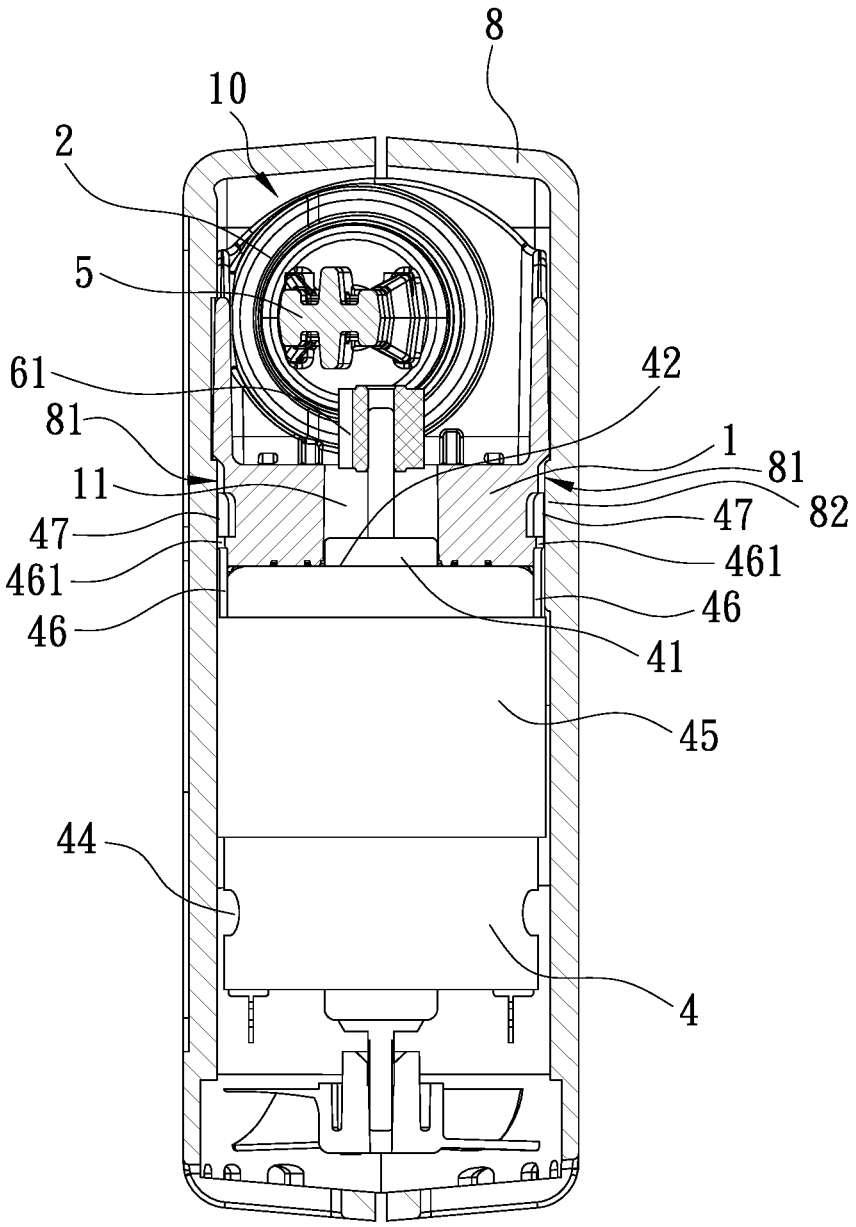
FIG. 13 is a cross sectional view of FIG. 12.

With reference to FIGS. 12 and 13, the air compressor 10 is received in the accommodation box 8, wherein two abutting portions 81 are formed on an inner wall of a first casing and an inner wall of a second casing of the accommodation box 8, and the two abutting portions 81 are two protrusions 82 of the accommodation box 8 configured to position the two wings 47 of the two locking extensions 46 between the motor 4 and the body 1, hence the air compressor 10 is received in the accommodation box 8 stably by using the two wings 47.

Thereby, the motor 4 includes the multiple coupling orifices 420 configured to engage on the multiple posts 110 of the body 1 so as to fix the motor 4 on the body 1 and to enhance the rotating force of the motor 4.

Preferably, the motor 4 includes at least one locking extension 45 configured to engage with the body 1, thus fixing the motor 4 on the body 1 securely without using any screws.

The air compressor 10 is received in the accommodation box 8, wherein the two abutting portions 81 are formed on the inner wall of the first casing and the inner wall of the second casing of the accommodation box 8, such that the two wings 47 of the two locking extensions 46 are positioned between the motor 4 and the body 1, and the air compressor 10 is received in the accommodation box 8 stably by using the two wings 47.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An air compressor being received in an accommodation box and comprising a body, and the body including:

multiple positioning orifices which are a first positioning orifice and a second positioning orifice;

a cylinder connected on the body and communicating with an air storage holder;

a motor fixed on the body, a small gear being received in the first positioning orifice, and a connection seat of the motor being accommodated in the first orifice, wherein the motor further includes two dissipation holes symmetrically formed on an outer wall of a casing thereof and configured to circulate airs and to dissipate heat from the motor, and the motor includes a magnetic coil fitted thereon and made of metal material so as to guide magnetism efficiently, when the motor operates;

a transmission mechanism actuating a piston to move in the cylinder reciprocately so as to produce compressed airs;

wherein the motor includes two locking extensions symmetrically extending from the magnetic coil which is fitted on the motor and configured to engage the motor with the body, each of the two locking extensions has a neck formed on a distal end thereof, wherein a width of each of the two necks is less than a width of the respective one of the two locking extensions, and each of the two necks has a wing extending from a distal end thereof, wherein a width of each of the two wings is equal to the width of the respective one of the two locking extensions, and the body further includes two receiving grooves defined on two sides thereof and corresponding to the two wings of the two locking extensions, wherein the two receiving grooves are a first receiving groove and a second receiving groove, and the two wings are located at the two receiving grooves of the body, wherein a pressing tool is configured to press the two wings into the first receiving groove and the second receiving groove of the two receiving grooves to form a first bent tab and a second bent tab, and the first bent tab and the second bent tab are pressed into the two receiving grooves, hence the motor is fixed on the body securely without using any screws.

2. The air compressor as claimed in claim 1, wherein the motor includes multiple coupling orifices defined on an head edge thereof adjacent to small gear and surrounding the connection seat, and the body includes multiple posts extending from a first outer wall thereof, surrounding the first positioning orifice, and corresponding to the multiple coupling orifices, such that when fixing the motor to the body, the multiple coupling orifices of the head edge of the motor are engaged on the multiple posts of the body so as to enhance a rotating force of the motor and to fix the motor on the body securely.

3. The air compressor as claimed in claim 2, wherein a coupling face has multiple through orifices formed thereon, when the multiple posts of the body are engaged with the multiple coupling orifices of the head edge of the motor, and the connection seat of the head edge of the motor is accommodated in the first positioning orifice.

4. The air compressor as claimed in claim 1, wherein the motor is removed from the body by ways of a removal tool, the removal tool is inserted into the two receiving groove of the body to move the first bent tab and the second bent tab of the two locking extensions away from of the body, and the motor is removed from the body easily and quickly.

5. The air compressor as claimed in claim 1, wherein the air compressor is received in the accommodation box, two abutting portions are formed on an inner wall of a first casing and an inner wall of a second casing of the accommodation box, and the two abutting portions are two protrusions of the accommodation box configured to position the two wings of the two locking extensions between the motor and the body, hence the air compressor is received in the accommodation box stably by using the two wings.

* * * * *